United States Patent [19]

Datta

[11] 4,213,804

[45] Jul. 22, 1980

[54] PROCESSING FOR CUBE-ON-EDGE ORIENTED SILICON STEEL

[75] Inventor: Amitava Datta, Gibsonia, Pa.

[73] Assignee: Allegheny Ludlum Industries, Inc., Pittsburgh, Pa.

[21] Appl. No.: 21,513

[22] Filed: Mar. 19, 1979

[51] Int. Cl.[2] ..... H01F 1/04

[52] U.S. Cl. ..... 148/111; 148/31.5; 148/113

[58] Field of Search ..... 148/111, 112, 113, 31.5, 148/31.55

[56] References Cited

U.S. PATENT DOCUMENTS

| | | | |
|---|---|---|---|
| 2,875,113 | 2/1959 | Fitz | 148/113 |
| 4,046,602 | 9/1977 | Stanley | 148/112 |
| 4,054,471 | 10/1977 | Datta | 148/112 |

*Primary Examiner*—L. Dewayne Rutledge

*Assistant Examiner*—John P. Sheehan

*Attorney, Agent, or Firm*—Vincent G. Gioia; Robert F. Dropkin

[57] ABSTRACT

A process for producing electromagnetic silicon steel having a cube-on-edge orientation. The process includes the steps of: preparing a melt of silicon steel containing from 0.02 to 0.06% carbon, from 0.0006 to 0.0080% boron, up to 0.0100% nitrogen and from 2.5 to 4% silicon; casting the steel; hot rolling the steel; cold rolling the steel to a thickness no greater than 0.020 inch; heat treating the steel at a temperature between 1550° and 2000° F. in a hydrogen-bearing atmosphere; removing at least 0.02 micron of surface from each side of the steel; heat treating the steel at a temperature between 1300° and 1550° F. in a hydrogen-bearing atmosphere; applying a refractory oxide coating to the steel and final texture annealing the steel.

10 Claims, No Drawings

PROCESSING FOR CUBE-ON-EDGE ORIENTED SILICON STEEL

The present invention relates to an improvement in the manufacture of grain oriented silicon steel.

U.S. Pat. No. 4,054,471 teaches a process for improving the magnetic properties of boron-inhibited grain oriented silicon steels by normalizing cold rolled steel of final gage at a temperature of from 1550° to 2000° F. Steel produced in accordance with said patent is characterized by a permeability of at least 1870 ($G/O_e$) at 10 oersteds and a core loss of no more than 0.700 watts per pound at 17 kilogauss-60 Hz. The process of said patent optionally includes a heat treatment within a temperature range of between 1400° and 1550° F., to promote further decarburization.

The present invention provides a process which improves upon that of U.S. Pat. No. 4,054,471. By incorporating a step wherein at least 0.02 micron of surface is removed from each side of the steel subsequent to the referred to 1550° to 2000° F. normalize and prior to the heat treatment aimed at promoting further decarburization, the present invention renders the steel more susceptible to decarburization and the subsequent formation of a high quality base coating. Part or all of a somewhat impervious oxide which forms during the 1550° to 2000° F. normalize is removed. This oxide has been found to hinder base coating formation and decarburization. A good base coating is needed to support stress producing finishing coatings which are generally applied to boron-inhibited grain oriented silicon steels subsequent to texture annealing. The steel should be decarburized to a carbon content of less than 0.005% as carbon can cause a deterioration in the magnetic properties of electrical devices.

It is accordingly an object of the present invention to provide an improvement in the manufacture of grain oriented silicon steel.

In accordance with the present invention, a melt of silicon steel containing from 0.02 to 0.06% carbon, from 0.0006 to 0.0080% boron, up to 0.0100% nitrogen and from 2.5 to 4.0% silicon is subjected to the conventional steps of casting, hot rolling, one or more cold rollings to a thickness no greater than 0.020 inch, an intermediate normalize when two or more cold rollings are employed, heat treating of the cold rolled steel at a temperature between 1550° and 2000° F. in a hydrogen-bearing atmosphere, a subsequent heat treatment at a temperature between 1300° and 1550° F. in a hydrogen-bearing atmosphere, application of a refractory oxide coating and final texture annealing; and to the improvement comprising the step of removing at least 0.02 micron ($\mu$m) of surface from each side of said steel subsequent to said heat treatment at a temperature between 1550° and 2000° F. and prior to said heat treatment at a temperature between 1300° and 1550° F. A hot rolled band heat treatment is also includable within the scope of the present invention. It is preferred to cold roll the steel to a thickness no greater than 0.020 inch without an intermediate anneal between cold rolling passes, from a hot rolled band having a thickness of from 0.050 to about 0.120 inch. Melts consisting essentially of, by weight, 0.02 to 0.06% carbon, 0.015 to 0.15% manganese, 0.005 to 0.05% of material from the group consisting of sulfur and selenium, 0.0006 to 0.0080% boron, up to 0.0100% nitrogen, 2.5 to 4.0% silicon, up to 1.0% copper, no more than 0.009% aluminum, balance iron, have proven to be particularly adaptable to the subject invention. Boron levels are usually in excess of 0.0008%. The refractory oxide coating usually contains at least 50% MgO. Steel produced in accordance with the present invention is characterized by a permeability of at least 1870 ($G/O_e$) at 10 oersteds and a core loss of no more than 0.700 watts per pound at 17 kilogauss-60 Hz.

The steel is heat treated (normalized) at a temperature between 1550° and 2000° F. to recrystallize the cold rolled steel, and at the same time to effect some decarburization. To promote further decarburization, it is heat treated at a temperature between 1300° and 1500° F. Decarburization proceeds more effectively at temperatures below 1550° F. Both heat treatments are performed in a hydrogen-bearing atmosphere. The hydrogen-bearing atmosphere can be one consisting essentially of hydrogen or one containing hydrogen admixed with nitrogen. A gas mixture containing 80% nitrogen and 20% hydrogen has been successfully employed. The $p_{H2O}/p_{H2}$ ratio of the hydrogen-bearing atmosphere of the 1550° to 2000° F. heat treatment is usually from 0.001 to 1.5, and generally from 0.01 to 0.8. Time at temperature is usually at least 5 seconds and generally from 10 seconds to 10 minutes. The $p_{H2O}/p_{H2}$ ratio of the hydrogen-bearing atmosphere of the 1300° to 1550° F. heat treatment is usually from 0.01 to 1.5 and generally from 0.02 to 0.8. Time at temperature is usually at least 30 seconds and preferably at least 60 seconds. The 1550° to 2000° F. heat treatment is preferably carried out at a temperature of 1600° to 1900° F. The 1300° to 1550° F. heat treatment is preferably carried out at a temperature of 1400° to 1500° F.

As a somewhat impervious oxide has been found to form during the 1550° to 2000° F. heat treatment, at least 0.02 micron of surface is removed from each side of the steel subsequent to the 1550° to 2000° F. heat treatment and prior to the 1300° to 1550° F. heat treatment. The oxide has been found to hinder base coating formation and decarburization. Although there is reason to believe that the removal of as little as 0.02 micron would be beneficial, the present invention usually removes at least 0.5 micron and generally at least 2 microns of surface from each side. The removal can be accomplished by either mechanical or chemical means. The decarburized steel has less than 0.005% carbon.

The following examples are illustrative of several aspects of the invention.

Four samples (Samples $A_1$, $A_2$, $B_1$ and $B_2$) of silicon steel were cast and processed into silicon steel having a cube-on-edge orientation from two heats (Heats A and B) of silicon steel. Samples $A_1$ and $A_2$ were from Heat A whereas Samples $B_1$ and $B_2$ were from Heat B. The chemistry of the heats appears hereinbelow in Table I.

TABLE I

| | COMPOSITION (wt. %) | | | | | | | | |
|---|---|---|---|---|---|---|---|---|---|
| HEAT | C | Mn | 8 | B | N | Si | Cu | A1 | Fe |
| A | 0.032 | 0.035 | 0.020 | 0.0012 | 0.0042 | 3.15 | 0.35 | 0.003 | Bal. |
| B | 0.028 | 0.035 | 0.020 | 0.0011 | 0.0045 | 3.14 | 0.35 | 0.003 | Bal. |

Processing for the samples involved soaking at an elevated temperature for several hours, hot rolling to a nominal gage of 0.080 inch, hot roll band normalizing, cold rolling to a final gage of approximately 12 mils, heat treating at a temperature of 1800° F. for approximately 2.3 minutes in an 80N-20H atmosphere having a $p_{H2O}/p_{H2}$ ratio of 0.35, heat treating at a temperature of 1475° F. for approximately 2.3 minutes in an 80N-20H atmosphere having a $p_{H2O}/p_{H2}$ ratio of 0.35, coating with a refractory oxide base coating and final texture annealing at a maximum temperature of 2150° F. in hydrogen. Samples $A_2$ and $B_2$ were pickled in an aqueous solution containing 10% $HNO_3$ and 2% HF, subsequent to the 1800° F. heat treatment and prior to the 1475° F. heat treatment. Pickling was continued until approximately 2.5 microns were removed from each side of the steel. Samples $A_1$ and $B_1$ were not pickled.

The carbon content of each of the samples was analyzed. The results appear hereinbelow in Table II.

TABLE II

| SAMPLE | CARBON CONTENT (wt. %) |
|---|---|
| $A_1$ | 0.0099 |
| $A_2$ | 0.0013 |
| $B_1$ | 0.0085 |
| $B_2$ | 0.0021 |

Table II clearly shows how the subject invention renders the steel more susceptible to decarburization. Samples $A_2$ and $B_2$ which were treated in accordance with the present invention had a carbon content under 0.005%, whereas that for Samples $A_1$ and $B_1$ was above 0.005%. Samples $A_1$ and $B_1$ were not processed in accordance with the present invention.

Each of the samples had a permeability of at least 1870 ($G/O_e$) at 10 oersteds and a core loss of no more than 0.700 watts per pound at 17 kilogauss-60 Hz. The subject invention is not directed at improving magnetic properties, but rather to a process which renders the steel more susceptible to decarburization and the subsequent formation of a high quality base coating.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing electromagnetic silicon steel having a cube-on-edge orientation, which process includes the steps of: preparing a melt of silicon steel containing from 0.02 to 0.06% carbon, from 0.0006 to 0.0080% boron, up to 0.0100% nitrogen and from 2.5 to 4.0% silicon; casting said steel; hot rolling said steel; cold rolling said steel to a thickness no greater than 0.020 inch; heat treating the cold rolled steel at a temperature between 1550° and 2000° F. in a hydrogen-bearing atmosphere; heat treating said steel at a temperature between 1300° and 1550° F. in a hydrogen-bearing atmosphere, said steel being decarburized to a carbon level below 0.005%, applying a refractory oxide coating to said steel; and final texture annealing said steel; the improvement comprising the step of removing at least 0.02 micron of surface from each side of said steel subsequent to said heat treatment at a temperature between 1550° and 2000° F. and prior to said heat treatment at a temperature between 1300° and 1550° F., thereby rendering said steel more susceptible to decarburization and the subsequent formation of a high quality refractory oxide coating.

2. A process according to claim 1, wherein said melt has at least 0.0008% boron.

3. A process according to claim 2, wherein at least 0.5 micron of surface is removed from each side of said steel.

4. A process according to claim 2, wherein said surface of said steel is mechanically removed.

5. A process according to claim 2, wherein said surface of said steel is chemically removed.

6. A process according to claim 2, wherein at least 2 microns of surface is removed from each side of said steel.

7. A process according to claim 2, wherein said heat treatment at a temperature between 1550° and 2000° F. is at a temperature between 1600° and 1900° F.

8. A process according to claim 2, wherein said heat treatment at a temperature between 1300° and 1550° F. is at a temperature between 1400° and 1500° F.

9. A process according to claim 1, wherein said melt consists essentially of, by weight, 0.02 to 0.06% carbon, 0.015 to 0.15% manganese, 0.005 to 0.05% of material from the group consisting of sulfur and selenium, from 0.0006 to 0.0080% boron, up to 0.0100% nitrogen, 2.5 to 4.0% silicon, up to 1.0% copper, no more than 0.009% aluminum, balance iron.

10. A process according to claim 9, wherein said melt has at least 0.0008% boron.

* * * * *